US009157589B2

(12) United States Patent
Chien

(10) Patent No.: US 9,157,589 B2
(45) Date of Patent: Oct. 13, 2015

(54) LED LIGHT HAVING A BUILT-IN PROJECTION LIGHT AND NIGHT LIGHT

(76) Inventor: Tseng-Lu Chien, Walnut, CA (US)

( * ) Notice: Subject to any disclaimer, the term of this patent is extended or adjusted under 35 U.S.C. 154(b) by 10 days.

(21) Appl. No.: 12/948,953

(22) Filed: Nov. 18, 2010

(65) Prior Publication Data

US 2012/0127759 A1 May 24, 2012

(51) Int. Cl.
*H01R 33/00* (2006.01)
*F21S 8/00* (2006.01)
*F21V 21/30* (2006.01)

(52) U.S. Cl.
CPC . *F21S 8/035* (2013.01); *F21V 21/30* (2013.01)

(58) Field of Classification Search
CPC ..... F21S 2/00; F21S 11/00; F21V 1/00; F21K 9/50; F21Y 2101/02
USPC ..... 362/641, 157, 642, 643, 644, 183
See application file for complete search history.

(56) References Cited

U.S. PATENT DOCUMENTS

| | | | | |
|---|---|---|---|---|
| 5,307,051 | A * | 4/1994 | Sedlmayr | 340/573.1 |
| 5,517,264 | A * | 5/1996 | Sutton | 353/119 |
| 6,072,606 | A * | 6/2000 | Huether et al. | 359/15 |
| 7,264,377 | B2 * | 9/2007 | Cooper et al. | 362/276 |
| 7,303,327 | B2 * | 12/2007 | Copeland et al. | 362/640 |
| 7,357,520 | B2 * | 4/2008 | Vitantonio et al. | 353/119 |

* cited by examiner

*Primary Examiner* — Anh Mai
*Assistant Examiner* — Jessica M Apenteng
(74) *Attorney, Agent, or Firm* — Bacon & Thomas, PLLC

(57) ABSTRACT

An LED light has a built-in projection light and a night light to offer at least two functions for people in a dark environment. The projection light can project an image from any type of display-unit irrespective of geometric shape or image source or type, including display of digital data, wireless digital data, an LCD or TFT screen display, or any other display, enabling images of enlarged size to be projected onto a preferred surface, making it easier for people to see the image. The built-in night light helps people see things in a dark environment.

16 Claims, 6 Drawing Sheets

LED LIGHT HAVING A BUILT-IN PROJECTION LIGHT AND NIGHT LIGHT

BACKGROUND OF THE INVENTION

This application has subject matter in common with the inventor's U.S. patent application Ser. Nos. 12/624,621, 12/622,100, 12/318,471, 12/318,470, 12/318,473, 12/292,153, 12/232,505, 12/232,035, 12/149,963, 12/149,964, 12/073,095, 12/073,889, 12/007,076, 12/003,691, 12/003,809, 11/806,711, 11/806,285, 11/806,284, 11/566,322, 11/527,628, 11/527,629, 11/498,874, 12/545,992, 12/806,711, 12/806,285, 12/806,284, 12/566,322, 12/527,628, 12/527,629, 12/527,631, 12/502,661, 11/498,881, 11/255,981, 11/184,771, 11/152,063, 11/094,215, 11/092,742, 11/092,741, 11/094,156. 11/094,155. 10/954,189, 10/902,123, 10/883,719, 10/883,747, 10/341,519, 12/545,992, 12/292,580, 12/710,918, 12/622,000, 12/710,561, 12/710,12/711,456, and 12/771,003.

The above-listed earlier filed cases apply optic theory to LED lights for outdoor or indoor application, and that are powered by alternating current (AC) or direct current (DC) supplied by and electric cord and plug for an outlet, a battery, a transformer, a solar power source, or another power source to create a plurality of LED light beams to illuminate a close area(s) and a remote area(s), the remote area being illuminated by projection means which may further incorporate the inventor's previously-disclosed features, such as more than one light source, more than one function, more than one optics means, and more than one projection means, utilizing the inventor's additional power saving and cost saving concepts.

Current market-available night lights have no projection function. To make up for this lack of a projection night light, the present inventor filed a large number of prior patent applications. The night light of the current invention improves upon the inventor's prior night lights in that the night light of the present invention not only may be powered by an outlet power source via prong means, but it also can be used on a desk top or any other location where light illumination can be provided to people during the night for indoors or outdoors use, the invention being applicable to any light device in which a night light has a built-in projection light for any purpose.

While projection lights are known in the toy market, there is no prior projection light having a built-in night light because a night light needs a continuous power source. Furthermore, the majority of projection lights are powered by batteries and have incandescent bulb light sources, which cannot be left continuously on because the batteries will last less than several hours. However, using newly available LEDs for power saving, one can get tens of hours if incorporated with the inventor's power saving circuit (described in U.S. patent application Ser. No. 12/711,456 and other patent applications of the inventor), so that the batteries will last more longer. The LED night lights having projection means described in the inventor's allowed U.S. patent application Ser. Nos. 12/232,505, 12/292,153, 12/318,473 differ from the conventional single projection lights for toys, hand-held projection lights, or desk top projection lights in that the conventional single projection lights lack the following features:

(a) a continuous switch position to keep the night light on all the time;

(b) housing parts designed to project light to and sit on a surface;

(c) a built-in night light—the majority of desk top projection lights not only lack a continuous turn-on night light switch, but even do not have a steady-on select switch;

(d) a power saving circuit selection—because earlier items were powered by a bulb which has super big power consumption, they have no night light function;

(e) a focus mechanism for obtaining a clear image during long distance projection—the majority provide only provide a clear image over a short distance from the projection head to the projection surface, which is not longer than people's one arms total length, with toys generally being designed for projection to a desk surface or near a wall so that larger, more distant images will not be clear at all;

(f) adjustable focus features for long distance projection beyond a human arm length; and (g) a swivel, spin, or rotate projection head design to allow an image to change position at any time and stay there while putting the projection light on a surface—because hand-carried items do not need to spin, but rather can change projection direction just by moving one's hand, such items do not need a swivel, spin, or rotate mechanism.

In contrast, features of preferred embodiments of an LED light with built-in projection light and night light include:

(1) The LED light with built-in projection light and night light can be connected to either an outlet power source or battery (energy storage means) to project an image, time, weather, message, display, digital data, cartoon characters, advertisement, seasonal data, promotion art, or other any other signals to people, so that the desired night light can have all kinds of light sources available from the marketplace, which is a very good combination;

(2) The LED light with built-in projection light and night light may incorporate a desired combination of switch means, conductive means, sensor means, remote control means, wireless means, digital data means, transmission means, photo sensor means, manual switch means, automatic means, motor means, gear set means, swivel means, rotating means, spin means, USB means, digital data storage means to have a proper function to cause the projection light to have desired functions, effects, or performance;

(3) The projection light and night light of the LED light can be turned on and off according to a predetermined timing, to provide desired light functions and performance selected from the marketplace.

(4) The projection light can have extra features including (4*a*) focus adjustment, (4*b*) changeable projection head position or orientation to project the image anywhere as desired, (4*c*) a projection head that can swivel, rotate, or spin, (4*d*) a proper housing design to allow the unit to be installed on any surface without movement, (4*e*) motor means to cause an image to be continuously changing, (4*f*) gear set means to cause the image to rotate at a desired speed, (4*g*) the image can be projected to appear a long distance away from the projection head, (4*h*) the LED light can be in the form of a desk top light with a base having a built-in night light with a switch to turn it on and for an extended period of time.

(5) The projection light may have a focus designed for a long distance which at least longer than arm's length.

(6) The projection light may project a focused image over a distance of three feet or more.

DETAILED DESCRIPTION OF THE PREFERRED EMBODIMENTS

Figure 1:
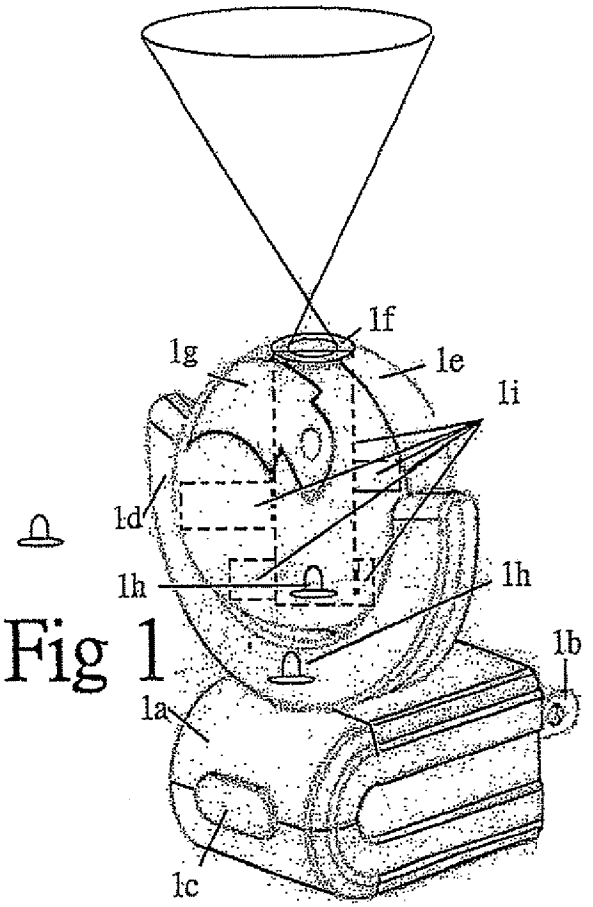
FIG. 1 shows a first preferred embodiment which has a built-in projection light and night light including a projection means, more than one light means, and swivel, rotate, or spin means to change the projection means' direction or orientation. The projection light may incorporate switch means, sensor means, or other means to cause the projection light or night light to turn on and turn off as required. The power source of this embodiment is an outlet power source connected by prong means.

FIGS. 1 and 1-*a* show a first preferred embodiment of an LED light Having a built-in projection light (1*f*) and night light (1*h*). As shown in FIG. 1-*a*, the at least one projection light has desired parts and accessories including a tubular assembly means (1*i*), telescope means (not shown), optics lens means (1-*j*), a display-unit assembly (1*f*) (10*g*), film, LCD means (1*f*), TFT means (1*f*), digital data means (1*f*), wireless digital means (1*f*), time piece means (1*f*), weather means (1*f*), screen means (1*f*), light block out means (1*d*), fixing means (1-d1), transparent means (open areas or display-unit segments and the like), translucent means (display-unit background, foreground, or the like), opening means, cut-out means (1-*i*''') (1-*i*''''), LED means (1-*c*), light means (1-*c* as other light source), a lens assembly, attachment means (1-*n*) (1-*p*) (1-*n*') (1-*p*'), support means (1-d2), or other parts and accessories (not shown) to project an image, time, weather, message, display, digital data, cartoon characters, advertisement, seasonal data, promotion art, light beams only, or any geometric art, drawing, photos, negative, positive film, LCD screen image, TFT screen image, display-unit image, or any other signals or message that can be recognized and seen by people.

As shown in FIG. 1, the LED light may have more than one light means (1*h*) (1*h*'), swivel means (extending poles or rotating Y-frame), rotate means, or spin means to change the projection means' direction or orientation. The projection light may incorporate switch means (1*c*), sensor means (1*c*), or other means (not shown) to cause the projection light or night light to turn-on and turn off as required. The power source for this embodiment is an outlet power source connected by prong means (1*b*).

Figure 2:
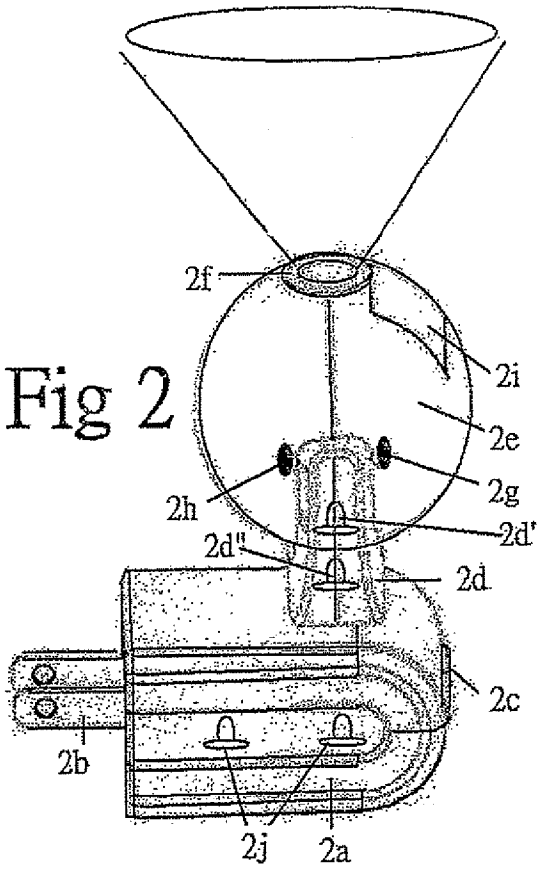
FIGS. 2, 3, 4, and 5 show the detailed construction of the first preferred embodiment including a front housing, back housing, more than one LED, sensor means, a battery cover, batteries, time adjustable switches, manual switches, photo sensor means, inner circuit means, LCD display means, digital data display means, and swivel, rotate, or spin means to allow the projection head to change position, base spin, swivel, or rotate means (the housing has movable features), a retractable or foldable prong means, housing means for the prong means or energy storage means, and/or time-related parts and accessories arranged in one area so as to simplify electric signal delivery.
Figure 3:
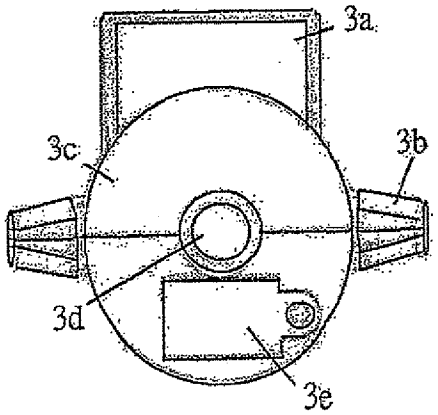
Figure 1A:
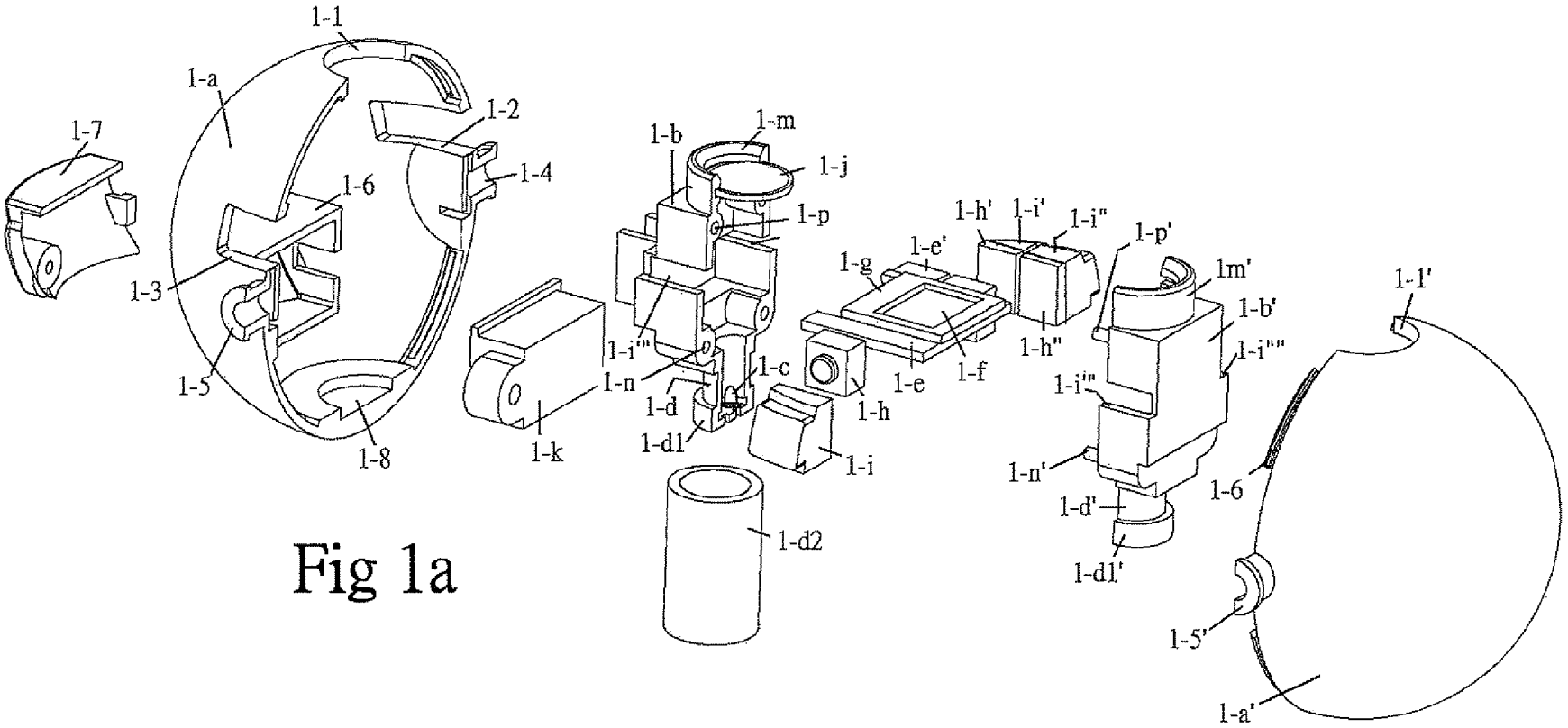
Figure 5:
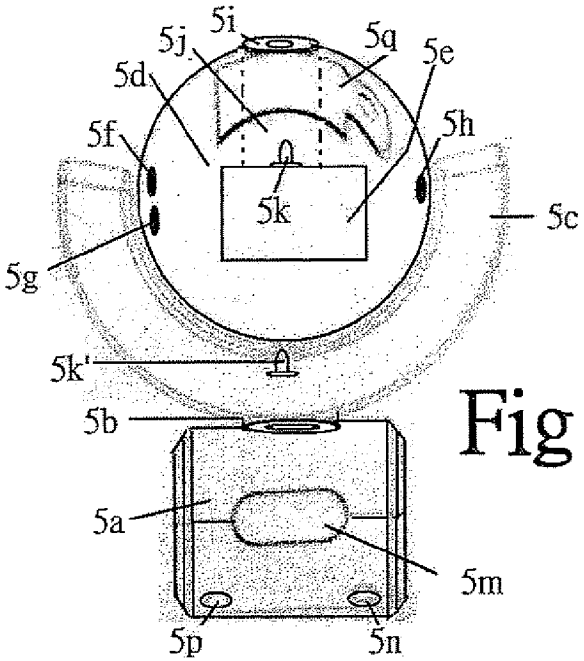
Figure 4:
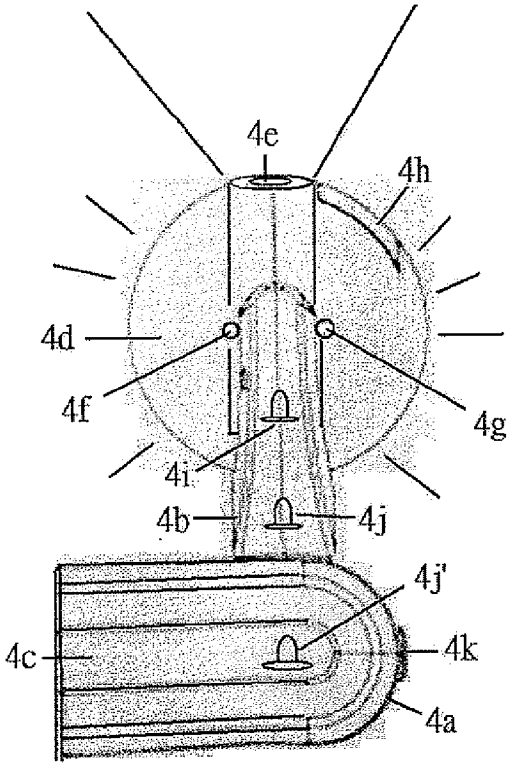
Figure 7:
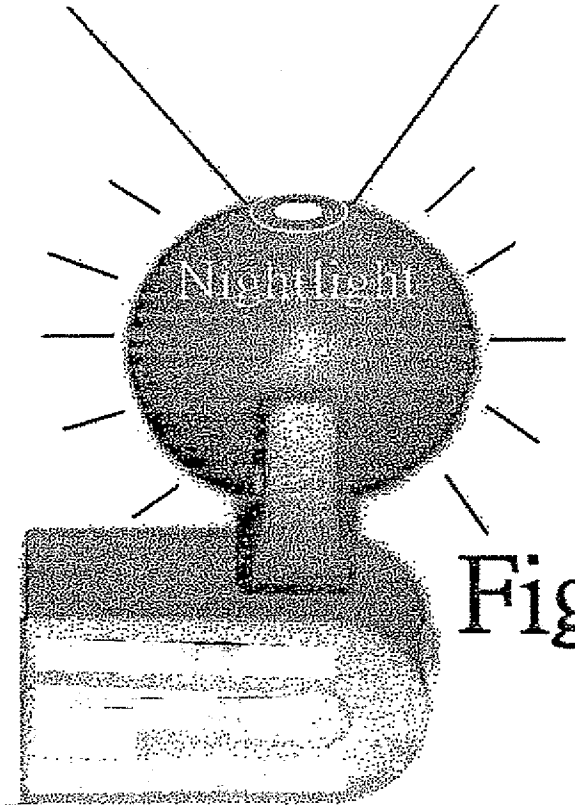
FIGS. 6, 7, 8, 9, and 10 are different views of the built-in projection light and night light shown FIGS. 1-5, taken from different viewing angles.
Figure 6:
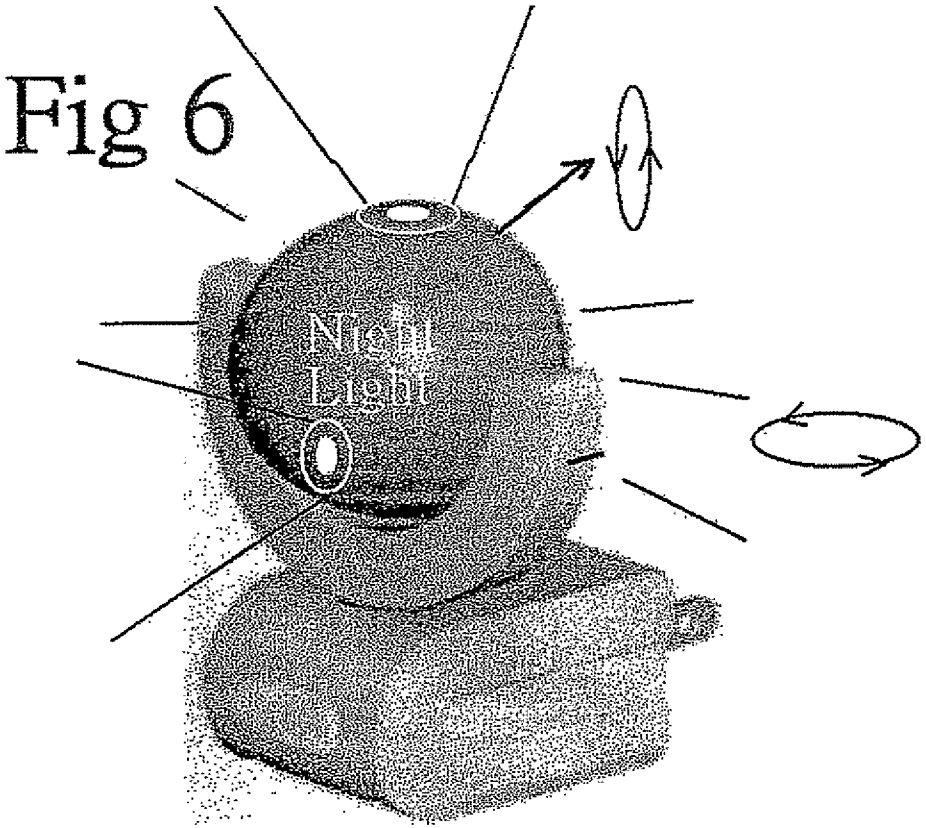
Figures 8, 9, 10:
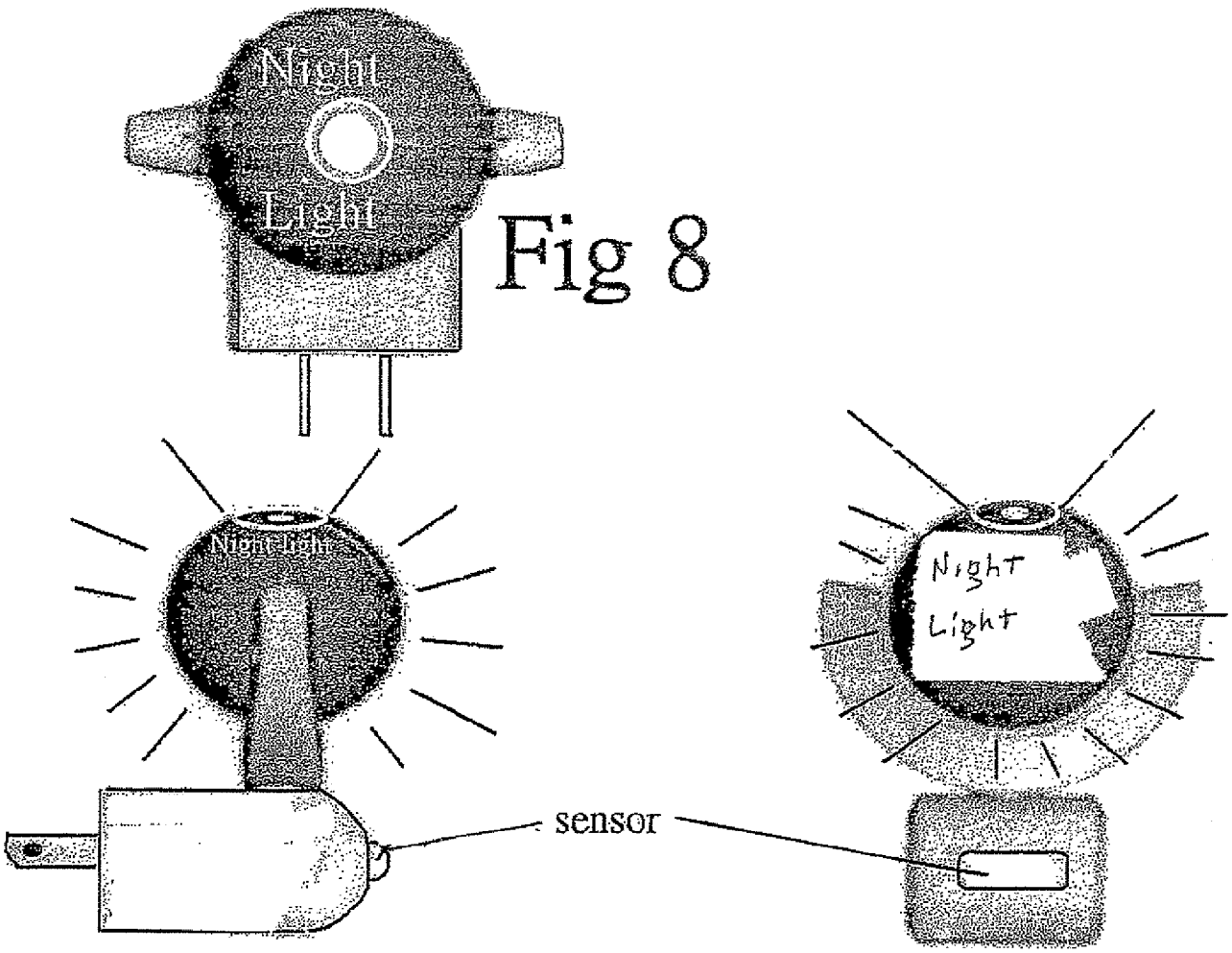

FIGS. 2, 3, 4, and 5 show the detailed construction of the first preferred embodiment. As shown in FIG. 2, a time display projection light has a built-in project light (2*d*') and night light (2*d*''). The projection light is part of a projection assembly (2*f*) including a housing (2*e*) and more than one LED (2*d*') (2*d*'') (2*j*), retractable or foldable prong means (2*b*), sensor means (2*c*), a battery cover (not shown), batteries, time adjustable and setting switch(s) (2*g*) (2*h*), manual switch(s) (2*c*), photo sensor means (2*c*), inner circuit means (not shown), LCD display means (see FIG. 1*a*), a digital data display means (FIG. 1*a*), swivel, rotate, or spin means to allow the projection head to change position, base spin, swivel or rotate means provided by the housing having movable features such as a Y-frame or ball that can rotate or spin), housing means for installing the prong means or energy storage means such as batteries, switch means arranged on a desired location on a ball or base, and/or time related parts and accessories (such as those shown in FIG. 1*a*) arranged in one area rather than more than one area. These FIGS. 2, 3, 4, and 5 all show a preferred construction for a time projection light having built-in time related parts and accessories.

FIGS. 6, 7, 8, 9, and 10 all show the embodiment of FIGS. 1, 1*a*, 2, 3, 4, and 5 taken from different viewing angles.

Figure 12:
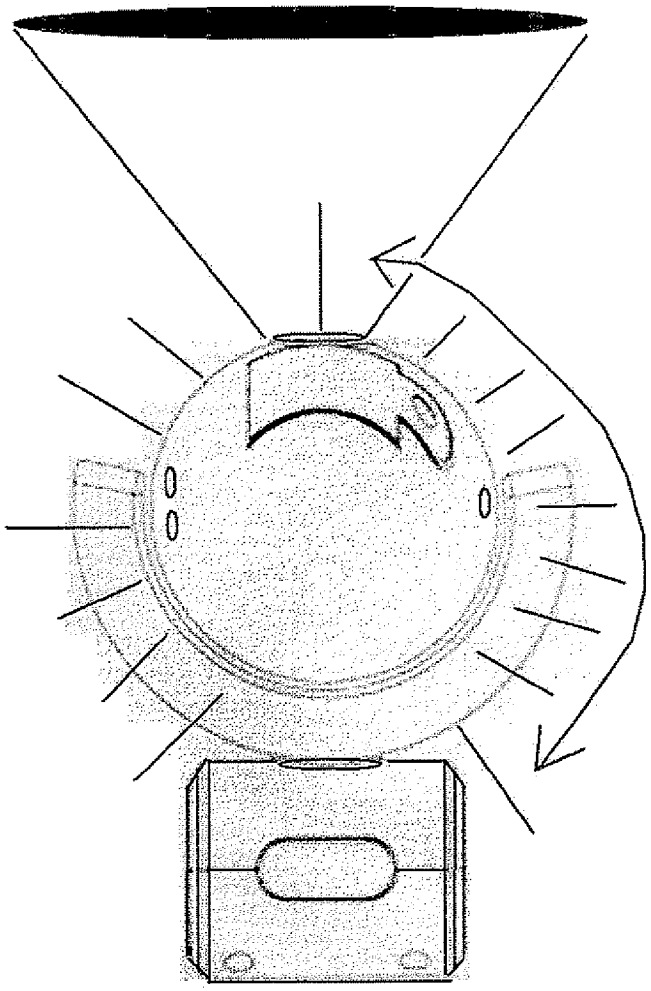
FIGS. 11 and 12 show variations of the preferred embodiment of FIGS. 1-10, with different shapes for horizontal 0-360 degree rotation and vertical 0-360 degree rotation to enable an image to be projected anywhere.
Figure 11:
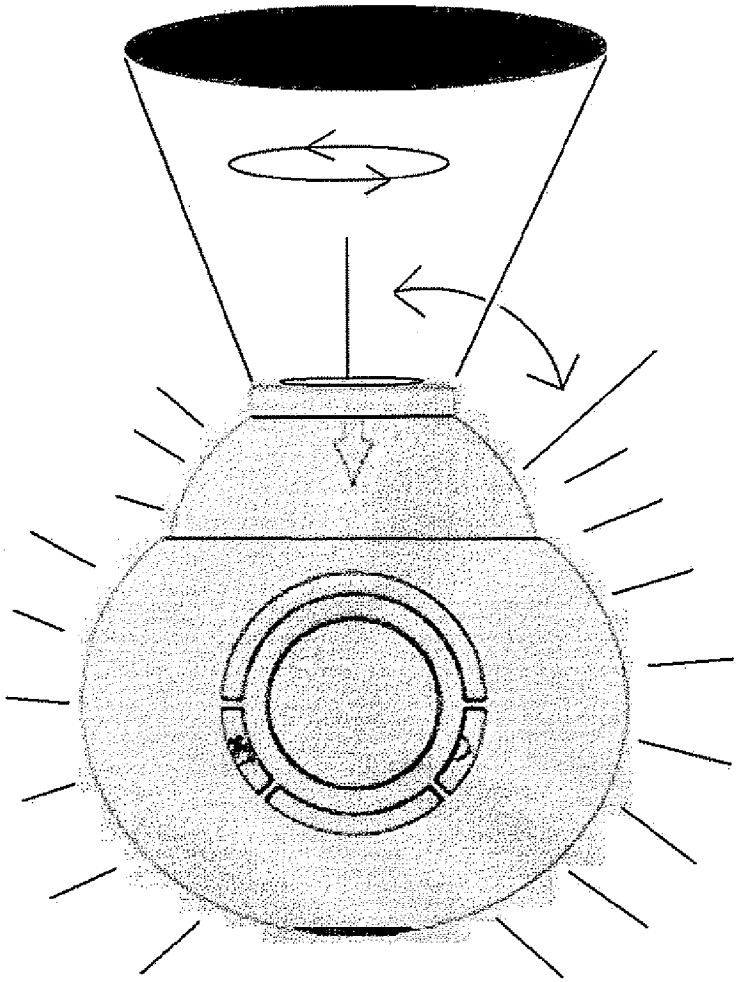

FIGS. 11 and 12 show the preferred embodiments of FIGS. 1 to 10 with different shapes corresponding to those disclosed in copending U.S. patent application Ser. No. 12/624,621 (see FIGS. 16-1) and Ser. No. 12/886,832 (See FIG. 5 and FIG. 5-1). Unlike the projection lights disclosed in the copending applications, the projection light of the preferred embodiment is capable of horizontal 0 to 360 degree rotation and vertical 0-360 degree rotation to enable an image to be projected to anywhere. The projection lights of the copending applications have horizontal 0 to 360 degree rotation but vertical rotation has limited angles whereas the Y-Frame can be rotated 0 to 360 degrees and the ball itself can rotate from 0 to 360 degree relative to the Y-frame).

The current invention has both a projection light and a night light, thereby providing at least two functions for the LED light, which is unique. It should also be appreciated that any alternative, revision, amendment, or improvement will fall within the scope of the invention as long as it provides similar or equivalent functions, performance, effects, and results.

The invention claimed is:

1. An LED light, comprising:

an LED light housing with movable parts; and at least one projection assembly in said LED light housing, said projection assembly including at least one LED and projection parts, the projection parts including:

a tubular assembly including a tube for preventing light leakage, the at least one LED being positioned such that narrow LED light beams enter a first end of the tube; and an optical projection lens at a second end of the tube for transforming the narrow LED light beams into wider area light beams thereby magnify and project an image formed by an image forming element, said image being projected onto a surface at least an arm's length away from said LED light, wherein said image forming element includes at least one of the following image forming elements situated at least partially in said tubular assembly between the first end of the tube and the second end of the tube:

(a) a fixed image forming element including a fixed display unit or film;

(b) a changeable image forming element including a time piece screen, LCD display, a TFT display, an Lcos display, or a digital data display;

(c) a wireless transmitting and receiving changeable digital data element, including a wireless digital data display, a weather display, or a wireless display screen; and (d) image-forming opaque, translucent, and transparent elements, wherein said at least one projection assembly is arranged to project at least one of the following images: time, weather information, messages, digital data, cartoon characters, advertisements, seasonal data, promotion art, graphics, and light beams only, and wherein said LED of the projection assembly is arranged to be turned on and off to achieve predetermined functions, effects or performance in response to a switch, sensor, manual control or wireless control, wherein the LED light is powered by one of:

(A) alternating current (AC) input through prongs plugged into an outlet and circuitry for converting the input AC into an LED circuit working current; and (B) direct current (DC) from a battery, USB wired power source, USB backup power source, solar power source, wind power source, generator power source, transformer having a DC power output, an adaptor having a DC power output, and a DC power storage element, wherein a position or orientation of the magnified image projected onto a desired surface is adjustable by applying a force to the movable parts of the said LED light housing.

2. The LED light of claim 1, wherein the housing, projection light LED, and projection light parts form a projection head that is arranged to swivel, rotate, or spin to change a position, orientation, or direction of the projection head.

3. The LED light of claim 1, wherein a focus of the projection light is adjustable.

4. The LED light of claim 1, wherein said housing contains multiple projection assemblies or heads aimed in different directions and arranged to swivel, rotate, or spin with said housing.

5. The LED light of claim 1, wherein the projection light only projects light beams to a distant surface.

6. The LED light of claim 1, wherein said housing has a position or orientation that is adjustable in three dimensions.

7. The LED light of claim 1, wherein the night light includes at least one second LED arranged to be turned on and off to selectively illuminate close areas while the at least one first LED serves as a projection light LED to illuminate distant areas.

8. The LED light of claim 1, wherein projection light includes an IC, timer, and time delay to achieve predetermined light performance effects.

9. An LED light, comprising:

a projection light including at least one first LED and projection parts including:

a sealed housing member including a tubular assembly for preventing light leakage, the LED being positioned such that light beams from the LED enter a first end of the tubular assembly;

an image forming element including at least one of a film, slide, display unit, LCD, TFT display, Lcos display, wireless digital display, changeable time display, weather display, and display screen; and an optical projection lens at a second end of the tube for magnifying and projecting an image formed by said image forming element, said image being projected onto a surface at least an arm's length away from said LED light; and at least one night light including at least one second LED which forms a means for illuminating an area near the LED light in a dark environment, wherein said at least one projection light being arranged to project at least one of the following images: time, weather information, messages, digital data, cartoon characters, advertisements, seasonal data, promotion art, graphics, and light beams only, and wherein at least one of the projection light and night light is arranged to be turned on and off to achieve predetermined functions, effects or performance in response to a switch, sensor, manual control or wireless control, wherein the LED light has a base arranged to install the LED light on a surface without any movement of the LED light, wherein the at least one second LED which forms a means for illuminating an area near the LED light is installed in said base, wherein the LED light further includes swivel, rotate, or spin means for enabling movement of the projection light by swiveling, rotating, or spinning said housing, said at least one first LED, and said projection light parts, relative to said base and said night light in order to project said images in any of a plurality of selected directions such that the projection light is movable relative to the night light, and wherein the LED light is powered by one of:

(A) alternating current (AC) input through prongs plugged into an outlet and circuitry for converting the input AC into an LED circuit working current; and (B) direct current (DC) from a battery, USB wired power source, USB backup power source, solar power source, wind power source, generator power source, transformer having a DC power output, an adaptor having a DC power output, and a DC power storage element.

10. The LED light of claim 9, wherein the night light is a pin-hole device which has plurality of pin-hole sized openings, cutouts, or holes which allow passage of light from the at least one second LED to form enlarged images of the openings, cutouts, holes on a ceiling or on walls that are at a higher location than the night light's plurality of pin-hole sized openings, cutouts, holes.

11. The LED light of claim 9, further including a second projection light for projecting a second image to a surface at least one arm's length away from the LED light.

12. The LED light of claim 9, wherein the night light has the following additional functions:

a. a power failure light or emergency light powered by backup batteries;

b. a motion sensor light which turns on the projection light when a person is within a predetermined distance and turns off after a predetermined period of time;

c. a remote control or wireless control night light which turns on or off in response to signals from an infrared transmitter, a Bluetooth transmitter, an RF transmitter, a WiFi router transmitter, or a wireless controller.

13. The LED light of claim 9, wherein said LED light is arranged to be installed on a desktop, wall, ceiling, or outlet.

14. The LED light of claim 9, wherein lighting functions of said LED light, including near-by illumination or remote-distance illumination or image projection, are controlled by a manual or auto sensor, or an electric wireless controller.

15. The LED light of claim 9, the LED light includes additional built-in lighting devices powered by a separate power source and power circuitry.

16. The LED light of claim 15, wherein the additional built-in lighting device is controlled by a separate controller.

* * * * *